US008136906B2

(12) United States Patent
Iwasaki

(10) Patent No.: US 8,136,906 B2
(45) Date of Patent: Mar. 20, 2012

(54) IMAGE RECORDING APPARATUS AND INK AMOUNT CALCULATION METHOD FOR THIS IMAGE RECORDING APPARATUS

(75) Inventor: Tadashi Iwasaki, Hachioji (JP)

(73) Assignee: Riso Kagaku Corporation, Tokyo (JP)

( * ) Notice: Subject to any disclaimer, the term of this patent is extended or adjusted under 35 U.S.C. 154(b) by 409 days.

(21) Appl. No.: 12/493,597

(22) Filed: Jun. 29, 2009

(65) Prior Publication Data

US 2009/0322818 A1 Dec. 31, 2009

(30) Foreign Application Priority Data

Jun. 30, 2008 (JP) ..... 2008-170282

(51) Int. Cl.
*B41J 29/38* (2006.01)

(52) U.S. Cl. ..... 347/17; 347/22; 347/29

(58) Field of Classification Search ..... 347/5, 9, 347/17, 22, 29
See application file for complete search history.

(56) References Cited

U.S. PATENT DOCUMENTS 4,380,770 A * 4/1983 Maruyama ..... 347/29
2006/0152541 A1* 7/2006 Isozaki et al. ..... 347/17

FOREIGN PATENT DOCUMENTS

JP 2006-199021 A 8/2008

* cited by examiner

*Primary Examiner* — Lam S Nguyen
(74) *Attorney, Agent, or Firm* — Holtz, Holtz, Goodman & Chick, PC

(57) ABSTRACT

An image forming apparatus calculates an ink temperature considering a thermal capacity near nozzles and an ink circulation flow quantity of a circulation pump in addition to an ink temperature when flowing into a recording head and an ink temperature when flowing out of the recording head, and accurately estimates a waste amount of the ink ejected from the nozzles in, e.g., maintenance processing other than image formation.

22 Claims, 4 Drawing Sheets

IMAGE RECORDING APPARATUS AND INK AMOUNT CALCULATION METHOD FOR THIS IMAGE RECORDING APPARATUS

CROSS-REFERENCE TO RELATED APPLICATIONS

This application is based upon and claims the benefit of priority from prior Japanese Patent Application No. 2008-170282, filed Jun. 30, 2008, the entire contents of which are incorporated herein by reference.

BACKGROUND OF THE INVENTION

1. Field of the Invention

The present invention relates to an image recording apparatus that, calculates an amount of ink waste used for, e.g., cleaning processing based on a temperature of an ink utilized for image recording, and to an ink amount calculation method for this image recording apparatus.

2. Description of the Related Art

In general, an image recording apparatus which ejects ink of a single color or a plurality of colors onto a recording medium to record an image (which will be referred to as a printer hereinafter) is known. As recording heads of this printer, there are a scanning (serial) type recording head which reciprocates for scanning in a width direction (a direction orthogonal to a carrying direction) of a recording medium to eject ink and a fixed recording head which oppositely carries a recording medium to eject ink.

In ink supply, a size and a weight of the scanning type recording head are reduced since this recording head is arranged on a carriage to be moved, and a scheme of replacing an ink cartridge having a small-capacity ink chamber provided therein is general. On the other hand, in the fixed recording head, a replaceable replenishment ink tank (or a main ink tank) having a larger capacity than that of the ink cartridge of the scanning type recording head is provided.

A user keeps up this printer and carries out regular maintenance (e.g., ink replenishment, cleaning of the recording head, or a measure for a jam error) except, e.g., a countermeasure against a failure. The user replaces the main ink tank based on notification (e.g., an ink replenishment instruction or warning of a remaining ink amount) from the printer. Therefore, accurately detecting a remaining ink amount is important when setting a timing for replacement. When a remaining ink amount cannot be accurately detected, for example, the user is urged to replace the ink tank even though the remaining ink amount is sufficient for recording, and replacement is eventually performed, which is not economical. Contrarily, the user is not informed of replacement of the ink tank even though the ink has run out, and a recording failure or waste of a recording medium occurs due to non-ejection of the ink.

In the printer, there are roughly two types of operations that consume ink. First, there is ejection of ink when recording an image. Second, there is ejection of ink during maintenance, which is carried out to maintain ejection performance during recording. Ejection of ink during maintenance is carried out to eliminate, e.g., paper powder or eject ink having high viscosity. This is an operation of ejecting ink from nozzles as required or at regular intervals and expelling air bubbles or foreign particles to restore or preservation ink ejection performance.

A remaining ink amount in the main ink tank cannot be accurately detected unless an ink consumption amount in these ink ejection operations is accurately detected. In these types of amounts, the ink ejection amount used for image recording can be accurately obtained to some extent based on, e.g., the number of times of ejection from nozzles or a particle diameter of an ink drop from the nozzles. On the other hand, as to the ink ejection amount in maintenance processing, since the ink may be ejected when the nozzles are not driven (due to suction of the ink from the outside of the recording head or application of a pressure from the inside of the recording head), an ejected ink waste amount must be additionally detected.

The ink waste amount ejected in the maintenance processing is greatly dependent on an ink temperature during ejection, i.e., a temperature near the nozzles. This suggests that ink ejection characteristics in the recording head greatly vary depending on an ink temperature as well as that an ink amount ejected from the nozzles greatly varies depending on an ink temperature. Therefore, for example, as disclosed in JP-A 2006-199021 (KOKAI), using a temperature gauge to manage an ink temperature is suggested. An ink waste amount ejected in maintenance is greatly dependent on an ink temperature during ejection, i.e., a temperature near the nozzles. If an ink waste amount can be accurately calculated, a remaining ink amount in the ink tank can be accurately detected.

BRIEF SUMMARY OF THE INVENTION

It is an object, of the present invention to provide an image recording apparatus that highly accurately estimates an ink temperature in a nozzle unit in a recording head and calculates a waste liquid amount of the ink ejected for a use application other than image recording, and an ink amount calculation method for this image recording apparatus.

According to an embodiment of the present invention, there is provided an image recording apparatus which records an image with respect to a recording medium, comprising: a recording head which has a plurality of nozzles that eject an ink and a common ink chamber that communicates with the plurality of nozzles; an upstream-side ink path which is connected with the recording head and through which the ink is supplied to the common ink chamber; a downstream-side ink path which is connected with the recording head and through which the ink is ejected from the common ink chamber; an ink path which annularly connects the upstream-side ink path, the common ink chamber, and the downstream-side ink path and through which the ink is circulated; an upstream-side temperature gauge which is installed in the upstream-side ink path; a downstream-side temperature gauge which is installed in the downstream-side ink path; and a maintenance unit which executes maintenance processing involving ejection of the ink from the nozzles to restore ink ejection performance in the recording head, wherein a control unit estimates a temperature of the recording head based on an output from the upstream-side temperature gauge and an output from the downstream-side temperature gauge and calculates an ink waste amount ejected from the nozzles by the maintenance processing based on the estimated temperature of the recording head and executing contents of the maintenance processing.

Moreover, there is provided an ink waste amount calculation method in an image recording apparatus, the apparatus comprising: a common ink chamber which communicates with a plurality of nozzles; an upstream-side ink path through which an ink is supplied to the common ink chamber; a downstream-side ink path through which the ink is ejected from the common ink chamber; an ink flow unit which circulates the ink in the upstream-side ink path, the common ink chamber, and the downstream-side ink path in the mentioned order; a detachable ink tank from which the upstream-side ink path is supplied with the ink; an upstream-side temperature gauge which is installed in the upstream-side ink path; a downstream-side temperature gauge which his installed in the downstream-side ink path; a maintenance unit which performs maintenance processing for restoring ejection properties of the recording head, the method comprising: a process of obtaining an output from the upstream-side temperature gauge and an output from the downstream-side temperature gauge; a process of calculating a temperature of the recording head based on the output from the upstream-side temperature gauge and the output from the downstream-side temperature gauge; and a process of calculating an ink waste amount ejected from the nozzles based on the calculated temperature of the recording head and execution contents of the maintenance processing.

Advantages of the invention will be set forth in the description which follows, and in part will be obvious from the description, or may be learned by practice of the invention. Advantages of the invention may be realized and obtained by means of the instrumentalities and combinations particularly pointed out hereinafter.

BRIEF DESCRIPTION OF THE SEVERAL VIEWS OF THE DRAWINGS

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

An embodiment according to the present invention will now be described hereinafter in detail with reference to the drawings.

Figure 1:
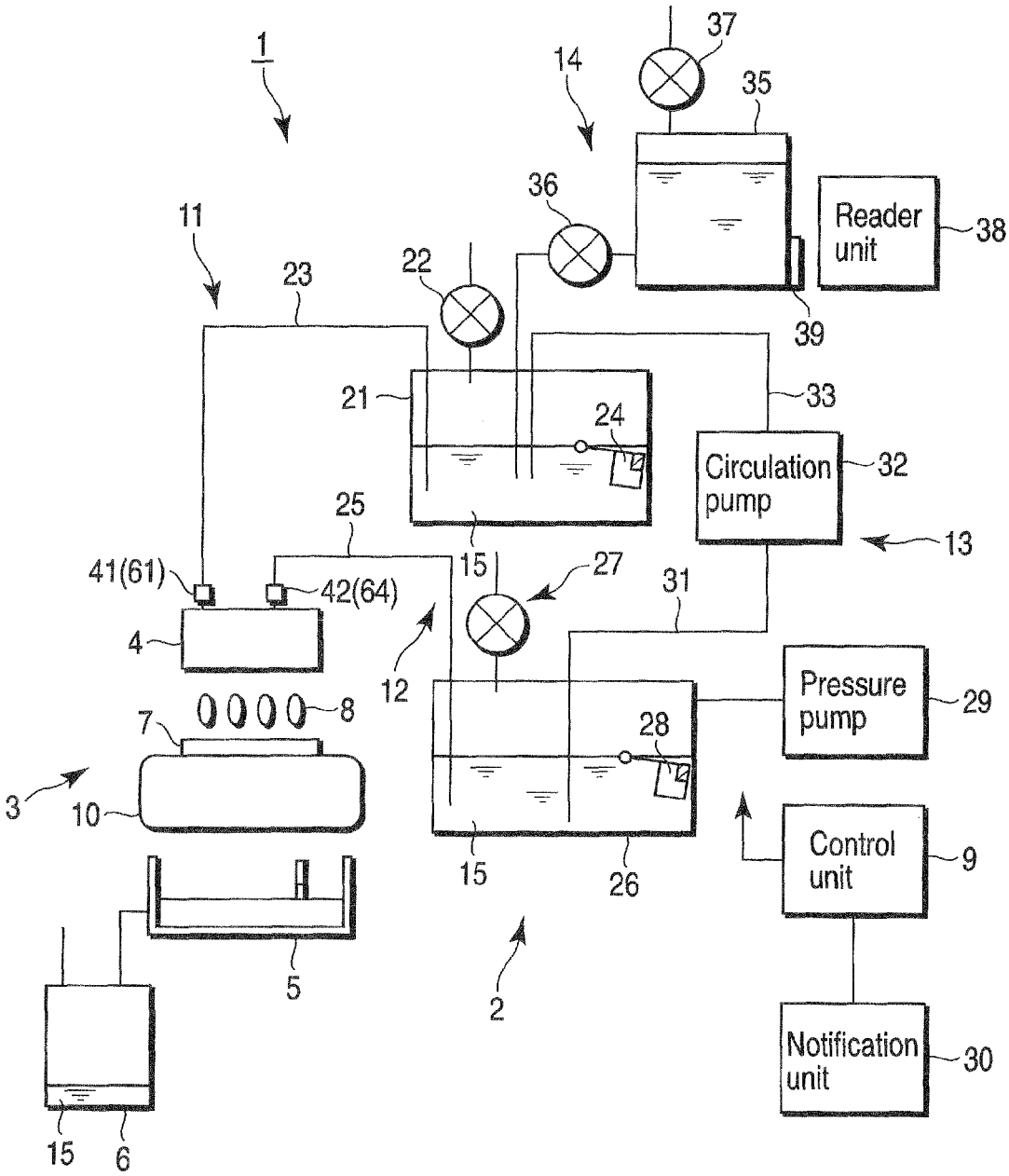
FIG. 1 is a view showing an example of an image recording apparatus that realizes a maintenance method according to the present invention.

An image recording apparatus and an ink disposal amount calculation method according to a first embodiment will now be described. FIG. 1 is a block diagram showing a structure of an image recording apparatus (which will be referred to as a printer hereinafter) as an example of an image recording apparatus. It is to be noted that an ink circulation path for one color is shown in an ink supply system depicted in FIG. 1, and a plurality of ink circulation paths corresponding to the number of colors are provided when recording a color image.

A printer 1 is roughly comprised of an ink supply system 2, a carrying mechanism 3 for a recording medium 7, a recording head 4 which ejects an ink, a maintenance unit 5, a waste liquid tank 6, a control unit 9, and a notification unit 30.

In the ink supply system 2, an ink supply path 11, an ink discharge path 12, and an ink return path 13 form an ink circulation path, and an ink replenishment path 14 is provided to the ink supply path 11. The ink circulates in this ink circulation path when an image recording operation is carried out.

An upstream tank 21, a downstream tank 26, a circulation pump 32, and a main ink tank 35) are arranged in respective ink paths of this ink supply system 2.

The ink supply path 11 connects the upstream tank 21 to the recording head 4 through an ink tube 23, and supplies the ink to the recording head 4 through the ink tube 23. The recording head 4 ejects a predetermined quantity of ink drops 8 toward the oppositely carried recording medium 7 at a predetermined timing. Although not shown, a filter may be provided in the ink supply path 11 to eliminate foreign particles or an ink agglomerate in the ink flow path. An electromagnetic valve 22 and an upstream tank liquid level sensor 24 are provided in the upstream tank 21. The electromagnetic valve 22 is opened/closed under control of the control unit 9 to open the upstream tank 21 to air or seal the same. The upstream tank liquid level sensor 24 is a sensor that detects a liquid level height of the ink in the upstream tank 21.

Figure 4:
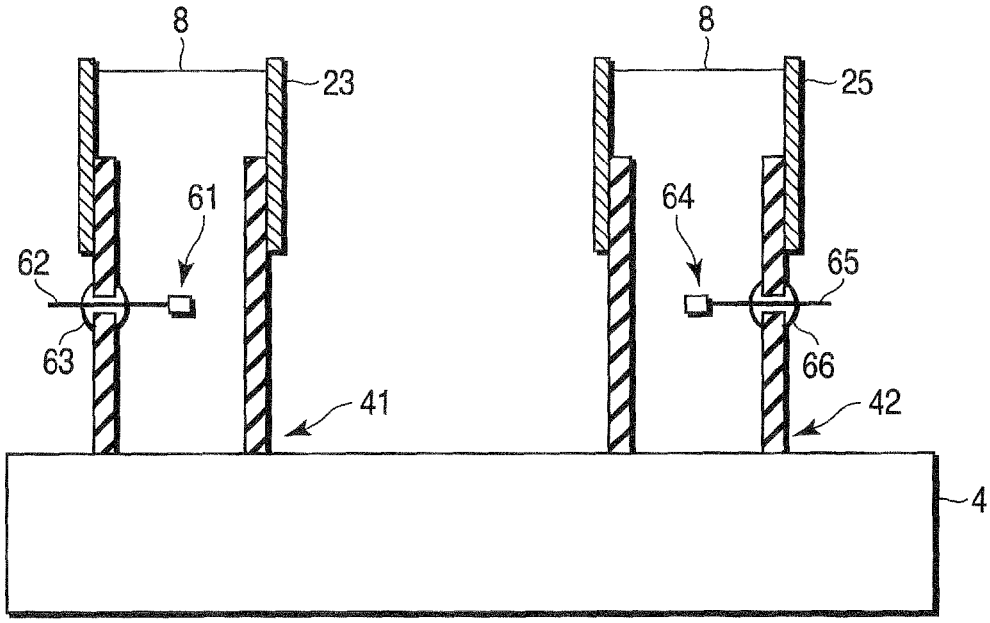
FIG. 4 is a view showing an arrangement structure of an upstream temperature gauge and a downstream temperature gauge provided in an upstream connection portion and a downstream connection port of the recording head.

The recording head 4 is provided in such a manner a nozzle surface 4P having a nozzle line in which pluralities of nozzles 4N are arranged in a line faces the recording medium 7. Additionally, an ink supply opening (an upstream connection port) 41 and an ink outflow opening (a downstream connection port) 42 are provided to the recording head 4. As shown in FIG. 4, an insertion opening is formed in the upstream connection portion 41 near the recording head 4, and an upstream temperature gauge 61 is inserted into this insertion opening. Likewise, an insertion opening is formed in the downstream, connection portion 42, and a downstream temperature gauge 64 is inserted into the insertion opening. Each of these upstream temperature gauge 61 and the downstream temperature gauge 64 is placed near the center of the connection port to measure a temperature of the ink.

Further, the insertion openings into which temperature wiring lines 62 and 65 are inserted are closed by sealants 63 and 66, whereby the ink does not leak to the outside. As the upstream temperature gauge 61 and the downstream temperature gauge 64, one of a thermistor, a thermocouple, and a platinum resistive element is used, for example. It is preferable for each of the upstream temperature gauge 61 and the downstream temperature gauge 64 to measure a temperature of the ink at a position close to the nozzles 4N of the recording head as much as possible. Furthermore, the temperature detection structure is net restricted to this structure. For example, the upstream temperature gauge 61 and the downstream temperature gauge 64 may be attached to the upstream connection port 41 and the downstream connection port 42 to indirectly measure a temperature of the ink. It is to be noted that, when indirectly measuring a temperature, a correction value (a parameter) may be obtained by actual measurement in advance and correction may be carried cut to approximate an actual temperature.

The ink discharge path 12 connects the recording head 4 to the downstream tank 26 through the ink tube 23, and the ink that is not used (unejected) flows out from the recording head 4 and flows into the downstream tank 26. An electromagnetic valve 27, a downstream tank liquid level sensor 28, and a pressure pump 29 are provided to the downstream, tank 26.

Of these members, the electromagnetic valve 27 is opened/closed under control of the control unit 9 to open the downstream tank 26 to air or seal the same. The downstream tank liquid level sensor 28 is a sensor that detects a liquid level height of the ink in the downstream tank 26. The pressure pump 29 is a part of maintaining means, and can increase a pressure in the ink circulation path by supplying outside air into the downstream tank 26. The downstream tank 26 is placed below the upstream tank 21, and a difference in height is provided between these tanks so that the ink can flow into the recording head 4 from the upstream tank 21 by its own weight (a gravitational force) and further flow into the downstream tank 26 from the recording head 4. This difference in height is appropriately set based on a design in such a manner that a meniscus can be formed in the recording head 4 and the unejected ink can flow into the downstream tank 26. In this embodiment, the main ink tank 35, the upstream tank 21, and the downstream tank 26 are arranged from a position that is high in a vertical direction in the mentioned order, and the recording head 4 is arranged at a height position between the upstream tank 21 and the downstream tank 26.

The ink return path 13 connects the downstream tank 26 to the upstream tank 21 through the circulation pump 32 and pumps up the ink into the upstream tank 21 from the downstream tank 26 to be resupplied. The circulation pump 32 drives except a period from start of a purge operation to end of a wipe operation in later-explained maintenance processing.

Further, the ink replenishment path 14 connects the main ink tank 35 to the upstream tank 21 through the electromagnetic valve 36 by using an ink tube and replenishes the upstream tank 21 with the ink from the main ink tank 35. The main ink tank 35 is arranged at a position higher than the upstream tank 21, and the ink flews through the ink tube by a gravitational force (the ink's own weight) and flows into the upstream tank 21. The electromagnetic valve 36 is opened/closed under control of the control unit 9 to replenish the upstream tank 21 with the ink, thereby adjusting an ink amount in the ink circulation path. The main ink tank 35 is detachable/connected by fitting a non-illustrated connector onto a connector of the ink tube.

Further, an electromagnetic valve 37 is provided in the middle part of the ink tube connected with the main ink tank 35, and it is opened/closed under control of the control unit 9 to open the main ink tank 35 to air or seal the same. A tag 39 is attached to the main ink tank 35. Identification information of each main ink tank 35 is recorded in this tag 39. A reader unit 38 that reads tag information is arranged near a position of the tag 39. The read tag information is transmitted to and managed by the control unit 9. This tag information includes at least an inherent number (an ID) and an ink color of the main ink tank 35 and an ink amount (a maximum amount) accommodated in the tank 35. It is to be noted that, when the main ink tank 35 is once removed in order to, e.g., repair the printer even though this tank has an ink in use remaining therein, the control unit 9 stores a remaining ink amount in association with an ID. Therefore, when the same main ink tank 35 is again disposed, the ID is confirmed, and then the remaining ink amount is reset. At this time, when a different main ink tank 35 is disposed, its ID is confirmed, and then an ink amount is newly set.

The control unit 9 receives sensor signals from sensors in the entire printer including the upstream tank liquid level sensor 24, the downstream tank liquid level sensor 28, the upstream temperature gauge 61, the downstream temperature gauge 64, and the reader unit 38. The control unit 9 executes driving control over all driven units in the printer 1 including the recording head 4, the medium carrying mechanism 10, the electromagnetic valves 22, 27, 36, and 37, the circulation pump 32, and the pressure pump 29 based on these sensor signals. A memory is provided in the control unit 9, and a later-explained temperature history or a temperature detected by the temperature gauge is recorded.

Furthermore, the medium carrying mechanism 10 is formed of, e.g., two rollers each having a length (a width) which is equal to or above a recording medium and a belt wound around these rollers. A driving source using a motor is connected to at least one roller, and the belt is thereby rotated and moved. Furthermore, many holes are formed in the belt, and a suction fan is arranged on the inner side of the belt. With this structure, the recording medium 7 is adsorbed onto a belt surface by the suction fan and carried to pass a part in front of the nozzle of the recording medium 4 with rotation of the belt. At this time, the recording head 4 ejects a predetermined quantity of ink drops 3 at a predetermined timing toward the recording medium 7 that is oppositely carried, thereby forming an image.

Figure 3:
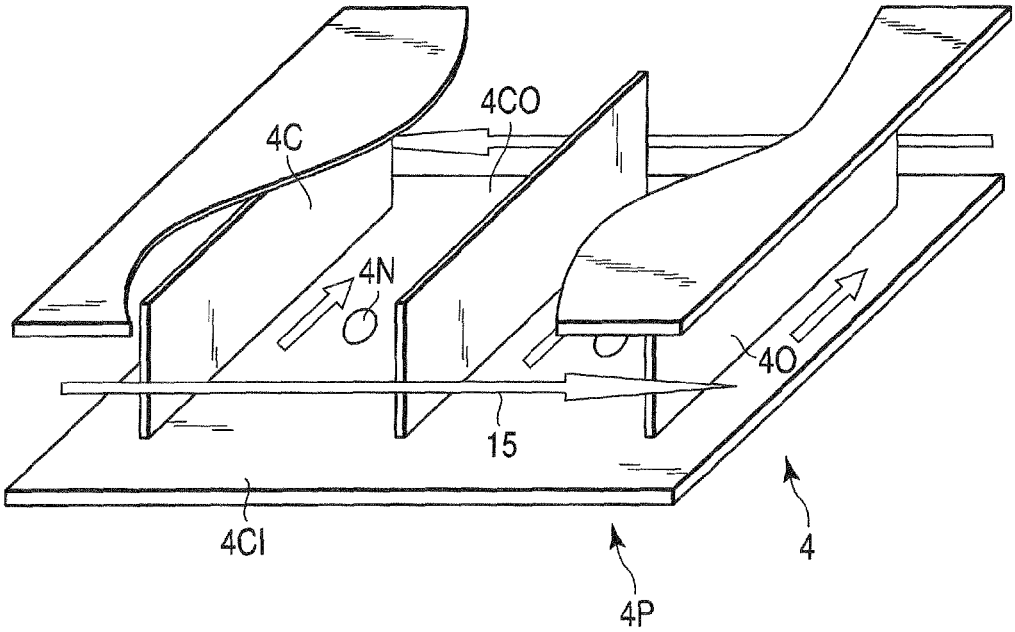
FIG. 3 is a view showing an inner structure near nozzles in a recording head.

FIG. 3 shows an inner structure near the nozzle in the recording head 4.

Vibrating plates 4O are aligned in parallel to work as bridges between an upstream-side common ink chamber 4CI and a downstream-side common ink chamber 4CO in the recording head 4. A nozzle 4N is opened in a bottom portion of each channel 4C which is a section partitioned by these vibrating plates 4O. The vibrating plate 4O is formed of, e.g., a piezoelectric element, and it produces a strain change when a predetermined electrical signal is input thereto. An ink 15 is ejected from the nozzle 4N by a pressure wave generated by this strain change. The ink 15 flows in from the upstream connection port 41 to enter the upstream common ink chamber 4CI, and flows through the downstream-side common ink chamber 4CO via each channel 4C to flow into the downstream connection port 42 in order.

Moreover, as shown in FIG. 1, the maintenance unit 5 serves as maintaining means for the recording head 4 in cooperation with the above-described pressure pump 29. The maintenance unit 5 is arranged at a standby position provided below the medium carrying mechanism 10 in a period other than maintenance. During maintenance, a non-illustrated moving mechanism moves the medium carrying mechanism 10 to be apart from the recording head 4, thereby providing a space. The maintenance unit 5 is moved into this space to abut on the recording head 4, thus effecting the maintenance processing.

Figure 2A:
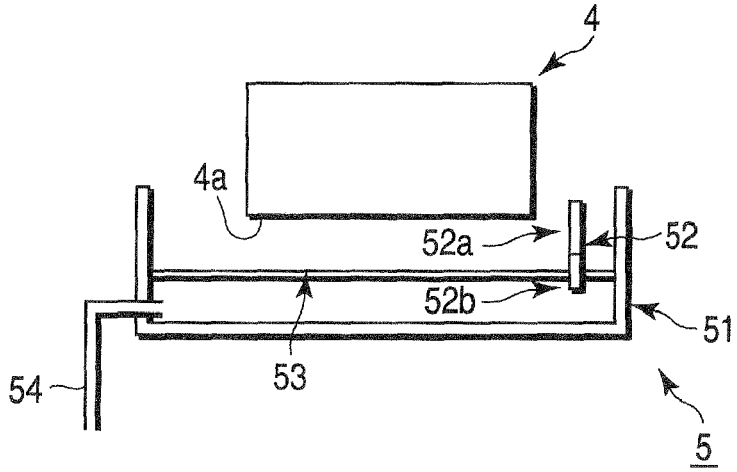
FIGS. 2A, 2B, 2C, and 2D are views for explaining operation steps of maintenance processing according to a first embodiment.

As shown in FIG. 2A, in the maintenance unit 5, an ink pan 51 having a size covering the recording head 4 and a rail 53 which is parallel to a direction of a nozzle line of the recording head 4 are provided. The ink pan 51 is connected with the waste liquid tank 6 (FIG. 1) through a tube 54, and the ink pan 51 accommodates ink waste in such a manner that spattered ink waste does not escape to the outside in the maintenance processing. The ink waste flows into the waste liquid tank 6 from the ink pan 51 through the tube 54 and stored there. When a storage amount in the waste liquid tank 6 exceeds a predetermined ink amount, the ink waste in the tank is discarded. Alternatively, the waste liquid tank 6 is replaced with an empty waste liquid tank 6.

Wiping means 52 is movably provided on the rail 53. The wiping means 52 is formed of a blade 52*a* that wipes the nozzle surface 4P and a support member 52*b* that is movably fitted on the rail 53 to support the blade 52*a*. A moving mechanism that enables movement on the rail 53 is provided to the support member 52*b*. The moving mechanism is formed of, e.g., two pulleys that are arranged on both end sides of the rail 53, a wire wound around the pulleys, and a motor that drives the pulleys to rotate. When the support member 52*b* is fixed to the wire, movement is enabled. Besides, a known mechanism, e.g., a mechanism formed of a combination of a bail screw and a ball nut or a rack-and-pinion mechanism can be used.

The blade 52*a* is formed of a resin member or a rubber member having hardness that does not damage the nozzle surface 4P, and Viton or a fluorine resin can be used, for example. Additionally, as shown in FIG. 2A, a height of the blade 52*a* is adjusted in such a manner that an upper end of the blade 52*a* becomes, e.g., 1 mm higher than the nozzle surface 4P. As the support member 52*b*, a material having a certain level of rigidity, e.g., a metal or plastic is preferable.

An operation of each constituent unit during ink circulation will now be described.

First, circulate on of the ink starts with activation of the printer. During this ink circulation operation, the electromagnetic valve 22 is opened to expose the upstream tank 21 to air, and the electromagnetic valve 27 is closed to seal the downstream tank 26. When the circulation pump 32 is driven in this state, the ink is supplied to the upstream tank 21 from the downstream tank 26.

Since the downstream tank 26 is sealed, the inside of the tank has a negative pressure with emission of the ink. As a result, the ink flows out from the upstream tank 21 and flows into the downstream tank 21 via the recording head 4. At this time, the circulation pump 32 is controlled by the control unit 9 in such a manner that the recording head 4 has a predetermined negative pressure preferable for image recording. Such a series of operations form ink flowing means. An ink recording operation with respect to the recording medium 7 is performed during ink circulation. It is to be noted that the positive pressure and the negative pressure described in each embodiment always mean a gauge positive pressure and a gauge negative pressure.

When the ink is not circulated, the electromagnetic valve 22 is closed to seal the upstream tank 21, the electromagnetic valve 27 is opened to expose the downstream tank 26 to air, and the circulation pump 32 is stopped. This ink non-circulation state is set in a standby mode where the image recording operation is not performed for a long time, a sleep mode set by a user, an energy saving mode, or a power supply OFF mode.

In this embodiment, the upstream tank 21, the downstream tank 26, and the ink tubes 23, 25, and 33 connecting these tanks are subjected to thermal exchange based on thermal radiation or thermal absorption with respect to an environmental temperature, and the ink always having the same temperature is supplied to the recording head 4. Therefore, a temperature output from the upstream temperature gauge 61 is constantly fixed. However, when the environmental temperature is considerably low or high, temperature adjustment may be carried out by a heater or a cooling element.

As explained above, the recording head 4 is arranged to have a height between the upstream tank 21 and the downstream tank 26 which are arranged with a difference in height, and it is set to have a negative pressure in both an ink circulation mode and a standby mode. Based on this setting, in each nozzle 4A of the recording head 4, a meniscus that an ink surface has an inwardly concave shape is formed. Even if the recording head 4 has a micro-positive pressure, e.g., a small positive pressure equal to or below approximately 1 kPa in this example, a surface tension of this meniscus prevents the ink from escaping or dripping onto one nozzle surface from the nozzle 4N. However, when the recording head 4 has a larger positive pressure, the meniscus is broken, and the ink escapes from the nozzles. Conversely, the micro-negative pressure is a small pressure which is equal to or below approximately −1 kPa and prevents the ink from escaping from the nozzles or air from entering.

When the ink is ejected by the image recording operation or the maintenance processing of the recording head 4 and an ink amount included in the ink circulation path is reduced to a predetermined amount or a smaller amount, each of the upstream tank liquid level sensor 24 and the downstream tank liquid level sensor 28 outputs a sensor signal to the control unit 9. The control unit 9 determines whether the ink should be replenished based on a predetermined algorithm in this sensor signal.

When it is determined that the ink is going to be replenished based on this determination, both the electromagnetic valves 37 and 36 are first opened, and the upstream tank 21 is filled with the ink from the main ink tank 35 under atmospheric pressure. This filling processing enables constantly maintaining the ink amount in the ink circulation path at an adequate amount.

Further, the notification unit 30 in the printer 1 displays a warning or outputs buzzer sound indicative of insufficiency of the ink, and the user is thereby urged to replace the empty main ink tank 35 with a new main ink tank 35 filled with the ink. The main ink tank 35 has no liquid level sensor mounted thereon, and an instruction of replacement is issued based on identification information of the tag 39 and a result of estimating a remaining ink amount from an ink amount consumed by a later-explained printing operation and the maintenance operation.

In this embodiment, when the printer 1 is first loaded with the main ink tank 35 to which the tag 39 having given identification information attached, it is considered that a predetermined maximum remaining ink amount is provided, and this information is recorded in the control unit 9. Thereafter, when the ink is ejected in image recording, a consumed ink amount is calculated from, e.g., image data, and a remaining ink amount is updated by subtracting the consumed ink amount each time after recording an image.

Likewise, a waste liquid amount used by a maintenance operation is read from a table previously created in accordance with an ink temperature or a maintenance sequence at the end of the maintenance operation every time the maintenance processing is performed, and the waste liquid amount is subtracted from a remaining ink amount recorded in the control unit 9. Then, the remaining ink amount is updated every time image recording and the maintenance processing are performed. When the remaining ink amount becomes equal to or lower than a predetermined ink amount, notification (or a warning) using display or buzzer sound indicative of replacement of the main ink tank 35 due to insufficiency of the ink is carried out. When the remaining ink amount is further reduced, a measure, e.g., stopping a recording operation is taken.

The maintenance processing will now; be described.

The maintenance processing is performed when ink is not ejected normally from the recording head 4 due to, e.g., clogging of the nozzles 4N with air bubbles or foreign particles, and a failure thereby occurs in an image recording operation, or when a failure has not occurred yet but a failure occurrence factor is present due to adherence of foreign particles, e.g., ink contamination or paper powder, to the nozzle surface. According to the maintenance processing, the pressure pump 29 increases a pressure in the ink circulation path to push out the ink in the recording head 4 from each nozzle 4N, and the suction pump is brought into contact with each nozzle to draw the ink and wipe the nozzle surface 4P, thereby reforming a normal ink meniscus and restoring ejection properties of the recording head 4.

In this maintenance processing, a plurality of types of tables are prepared in accordance with, e.g., a degree of ejection failure of the recording head 4. For example, as a first cable, a relatively small positive pressure is applied to the nozzles 4N for a short time with respect to a mild ejection failure, and regular maintenance having a relatively small waste liquid amount is carried out. In a second table, the pressure pump 29 applies a relatively large positive pressure to each nozzle 4N for a long time to belch the ink in regard to a severe election failure. In this second table, intensive maintenance processing is carried out, and a waste liquid amount is relatively large.

Further, as a third table, in regard to an ejection failure that nozzle ejection properties are not restored even in the second table, special maintenance or the like which performs the intensive maintenance processing while applying vibration that the ink is not belched from each nozzle 4N is prepared, Furthermore, application of a pressure to each nozzle 4N and an intensity or a waveform of vibration to be applied in the first to third tables can be further segmented to increase the number of tables.

Operation steps of the maintenance processing in this embodiment will now be described. FIGS. 2A to 2D show operation steps of the maintenance processing.

In the maintenance processing, when a recording failure occurs, for example, when white lines or the like are observed in an image recorded on the recording medium 7, a user issues a maintenance command to the control unit 9. Alternatively, after images are recorded on a predetermined number of recording mediums, or when a power supply is turned on after a predetermined time or a longer time has passed from a power supply OFF state, the maintenance command is automatically issued. The maintenance processing is started in response to such commands.

First, the medium carrying mechanism 10 moves away from a recording position to a predetermined escape position on a side part or a lower part. As shown in FIG. 2A, the maintenance unit 5 moves to a position where it faces the nozzle surface IP. At this time, the blade 52*a* is retired to a side part of the nozzle surface 4P.

Then, a purge operation based on ejection of the ink is carried out. In the purge operation, the circulation pump 32 is first stopped, the electromagnetic valves 22 and 27 are closed, and then the pressure pump 810 applies a pressure to the upstream tank 21 through the downstream tank 26 and the ink path. At this time, a gauge pressure of the recording head 4 is, e.g., 20 kPa. After a predetermined time passes, the electromagnetic valves 22 and 27 are opened, a pressure in each of the upstream tank 21 and the downstream tank 26 is restored to atmospheric pressure, and then the electromagnetic valves 22 and 27 are again closed with a predetermined timing difference. As a result, a nozzle pressure becomes a micro-positive pressure.

Figure 2B:
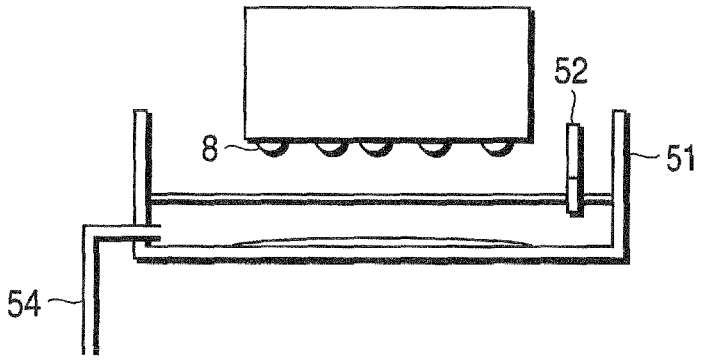

Based on this purge operation, as shown in FIG. 2B, the ink escapes from each nozzle 4N to drip into the ink pan 51, and some of the ink remains as drops on the nozzle surface 4P. It is to be noted that the nozzle pressure means a gauge pressure in the ink near the nozzles 4N or the meniscus in the embodiment. The control unit 9 determines a driving amount of the pressure pump 29 or opening/closing timings of the electromagnetic valves 22 and 27 in the purge operation in accordance with, e.g., a nozzle temperature TN as will be explained later.

Figure 2C:
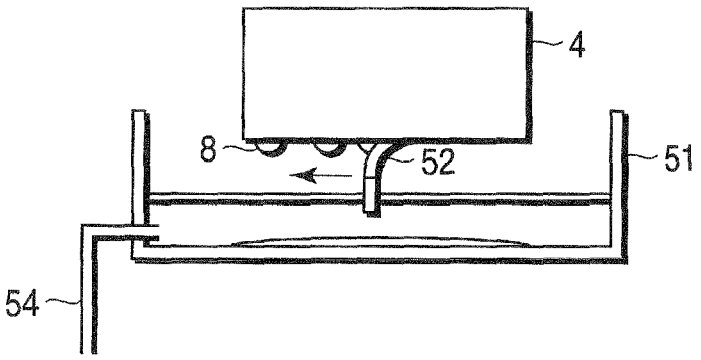
Figure 2D:
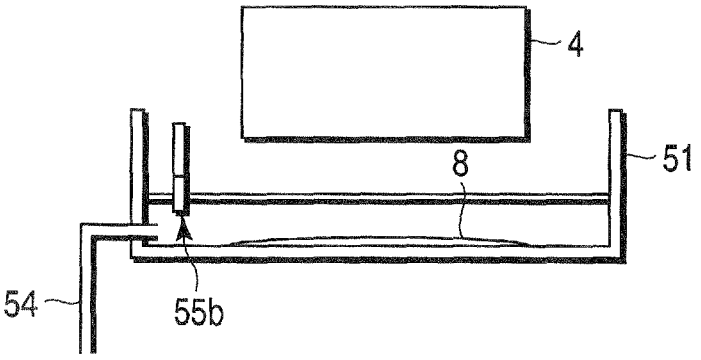

Then, as shown in FIG. 2C, the blade 52 a moves to remove remaining ink drops present on the nozzle surface 4P, thereby forming the meniscus. At this time, although the meniscus slightly protrudes from each nozzle due to a function of the micro-positive pressure, it is not of such a size that it breaks, and hence the ink does not escape. As shown in FIG. 2D, after the blade 52*a* passes the nozzle surface 4P, the electromagnetic valve 27 is again opened, thereby terminating the maintenance processing. Thereafter, the circulation pump 32 again starts driving, and the printer again enters the recording enabled state.

At last, the maintenance unit 5 moves away from the recording head 4 to the predetermined escape position. At this time, the blade 52*a* returns to an initial position depicted in FIG. 2A. Further, when the medium carrying mechanism 10 returns to a predetermined image recording position, the maintenance processing is terminated.

An ejection amount (a waste liquid amount) of the ink in the purge operation in the maintenance processing will now be described. In the following explanation, in regard to an ink temperature measured by the upstream temperature gauge 61, a temperature output (a nozzle temperature) near the nozzles is determined as an upstream temperature TI. Furthermore, a temperature output measured by the downstream temperature gauge 64 is determined as a downstream temperature TO. Moreover, an environmental temperature is a temperature a round the printer.

An ink waste amount discarded by the purge operation is determined based on the ink temperature (the nozzle temperature) TN near the nozzles and a pressure waveform applied to the nozzles. Adjustment of the pressure based on control by the pressure pump 29 is generally easy. Therefore, if the nozzle temperature TN can be precisely detected, a waste liquid amount can be accurately controlled.

In the ink circulation system, although the downstream temperature TO is relatively close to the nozzle temperature TN, if the nozzle temperature TN is approximated by using the downstream temperature TO alone, a large error may occur depending on an environment. In this embodiment, the nozzle temperature TN is estimated by the following method.

A temperature output from the upstream temperature gauge 61 is used as an upstream temperature TI and a temperature output from the downstream temperature gauge 64 is used as a downstream temperature TO, and the nozzle temperature TN is determined based on the following expression.

$$TN=f(TI,TO) \qquad \text{Expression (1)}$$

A function f(TI, TO) is, e.g., a function that internally divides or externally divides the upstream temperature TI and the downstream temperature TO, and it is represented by the following expression.

$$f(TI,TO)=(n\times TI+m\times TO)/(m+n) \qquad \text{Expression (2)}$$

(where m and n are actual numbers)

These values of m and n are determined based on various factors, e.g., installing positions of the upstream temperature gauge 61 and the downstream temperature gauge 64, a thermal capacity near each nozzle 4N, a driving amount of the circulation pump 32, i.e., a circulation flow quantity of the ink, and others. For example, when a path length from the nozzles 4M to the upstream temperature gauge 61 is equal to that from the nozzles 4N to the downstream temperature gauge 64, m=n=approximately 1 is achieved. Moreover, each of m and n may be a function of the upstream temperature TI and the downstream temperature TO, i.e., m(TI, TO) or n(TI, TO).

Examples (1) and (2) where the path length to the upstream temperature gauge 61 is different from that to the downstream temperature gauge 64, i.e., m and n are different from each other will now be described hereinafter.

Figure 5:
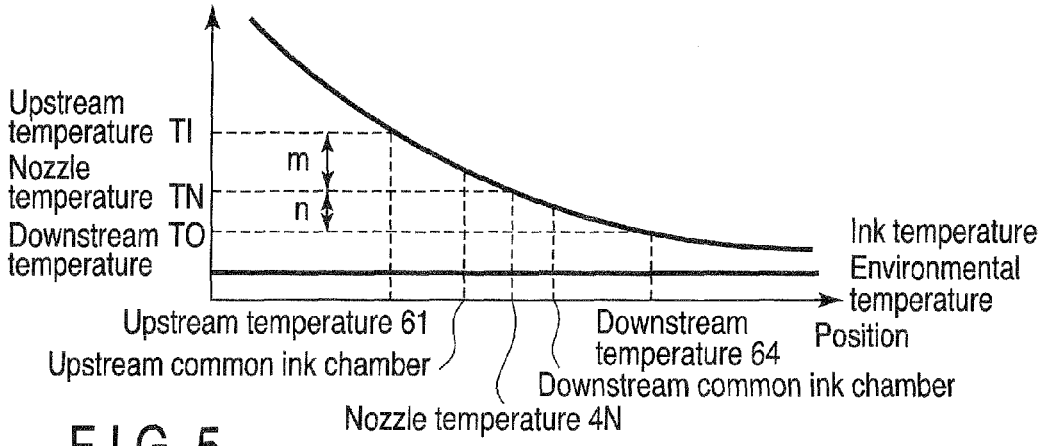
FIG. 5 is a view showing a relationship between a position and a temperature output of the temperature gauge when an upstream ink temperature is higher than an environmental temperature.

(1) As shown in FIG. 5, when the printer 1 is installed in a room and an ink temperature in the upstream tank 21 is increased beyond an environmental temperature by, e.g., air conditioning, since the ink radiates heat to the environment to be cooled as it flows if the recording head 4 is not driven, the following relationship is achieved.

Upstream temperature TI>Nozzle temperature TN>Downstream temperature TO>Environmental temperature.

In this case, generally, it is preferable to determine m>n>0 and weight the downstream temperature TO side. It is to be noted that the ink is circulated and humidified at this moment. An ink temperature in the upstream tank 21 in this state is measured.

Figure 6:
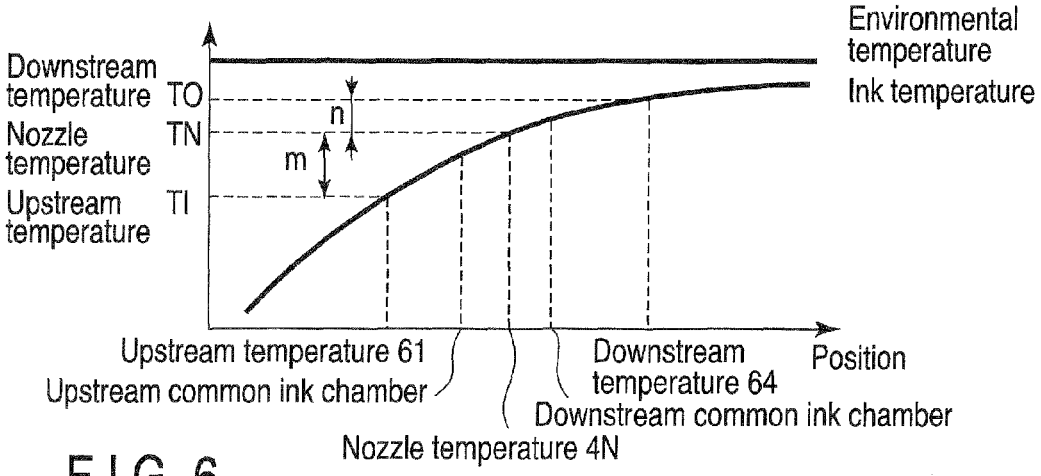
FIG. 6 is a view showing a relationship between a position and a temperature output of the temperature gauge when an upstream ink temperature is lower than an environmental temperature.

(2) Contrarily, as shown in FIG. 6, when an ink temperature in the upstream tank 21 is reduced to be lower than an environmental temperature, since the ink absorbs heat from the environment to be heated as it flows if the recording head 4 is not subjected to, e.g., driving, the following relationship is achieved.

Upstream temperature TI<Nozzle temperature TN<Lower temperature TO<Environmental temperature In this case, generally, it is likewise preferable to determine m>n>0 and weight the downstream temperature TO side, but m and n are generally different from those in (1).

Figure 7:
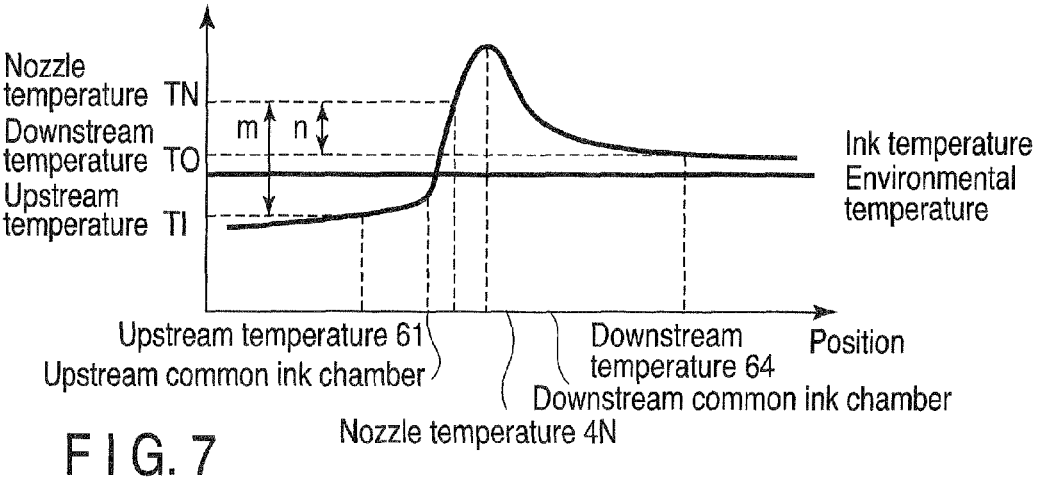
FIG. 7 is a view showing a relationship between a position and a temperature output of the temperature gauge when an upstream ink temperature greatly changes with respect to an environmental temperature.

(3) As shown in FIG. 7, when an ink flow path from the nozzles 4N to the downstream temperature gauge 64 is long and thermal radiation to the environment in this path is large, the following relationship is achieved even in a humidification process where the reading head 4 is driven.

Upstream temperature TI<Environmental temperature<Downstream temperature TO<Nozzle temperature TN.

In this example, m>0 and n<0 must be achieved. In these examples, since behaviors vary depending on each printer apparatus structure, m and n must be optimized in accordance with the upstream temperature TI and the downstream temperature TO for each design.

As explained above, according to this embodiment, the upstream temperature TI is used in addition to the downstream temperature TO detected immediately after end of image recording or immediately after stopping of ink circulation, and the environmental temperature in the circumference is also taken into consideration, thereby accurately obtaining the nozzle temperature TN. As a result, a waste ink amount ejected in, e.g., the maintenance processing except image recording can be also accurately acquired in the light of characteristics obtained based on the ink temperature.

Further, adding the waste ink amount with the ink amount used for image recording enables grasping an entire ink consumption amount, thus accurately calculating a remaining ink amount remaining in the main tank.

A second embodiment will now be described.

This embodiment has the same structure as the first embodiment, and different parts thereof will be described. In this embodiment, when ejecting an ink from nozzles in maintenance processing, whether an ink temperature obtained from a detected upstream temperature TI and a detected downstream temperature TO matches with a current nozzle temperature is determined.

First, whether an ink is being circulated or a predetermined time is yet to pass after end of circulation at the present moment is first determined in a period from input of a maintenance command to start of a purge operation. If the ink is being circulated or the predetermined time (the time A) is yet to pass after end of circulation as a result of this determination, it is determined that the temperature of the ink is closely related to the nozzle temperature TN. Thus, execution of processing after the purge operation is allowed.

However, if the predetermined time or a longer time has already passed after end of ink circulation, it is considered that a nozzle temperature TN cannot be estimated, an ink circulation operation is performed for a predetermined time (a time B), and then execution of processing after the purge operation is allowed.

The reason for executing the control in the above manner is as follows: The nozzle temperature TN estimated from the upstream temperature TI and the downstream temperature TO considerably deviates from an actual value due to the temperature of the ambient atmosphere (e.g., air temperature) if a period of, e.g., 15 seconds or more has elapsed after end of circulation. Therefore, a circulation operation is carried out for, e.g., 10 seconds in such a manner that the nozzle temperature TN is sufficiently reflected in the downstream temperature TO. A lapse time and a circulation time after end of the circulation are determined based on various factors, e.g., installation positions of the upstream temperature gauge 61 and the downstream temperature gauge 64, the upstream temperature TI, the downstream temperature TO, a thermal capacity near each nozzle 4N, a driving amount of the circulation pump 32, i.e., a circulation flow amount of the ink, and others.

As explained above, in this embodiment, whether the nozzle temperature TN can be accurately estimated from the upstream temperature TI and the downstream temperature TO is determined. If the nozzle temperature TN can be accurately estimated, the processing immediately advances to the purge operation. However, when estimation is impossible, since the ink temperature is adjusted and then the purge operation is executed, a maintenance waste liquid amount can be accurately calculated.

A third embodiment will now be described.

This embodiment has the same structure as the first embodiment, and different parts will be described.

According to this embodiment, in a period from input of a maintenance command to start of a purge operation, whether an ink is being circulated or a predetermined time is yet to pass after end of circulation is determined. If the predetermined time (a time C) or a longer time has passed after end of circulation, m and n in Expression (2) are calculated by a predetermined method without performing a circulation operation, and processing after the purge operation is carried out.

When the circulation operation is stopped for a long time so that a nozzle temperature TN can fit in an environment, m=n=1 is achieved, and a nozzle temperature is set to an average temperature of an upstream temperature TI and a downstream temperature TO. Alternatively, it is preferable to set n>m>0 and weight the upstream temperature TI.

In general, since the nozzle temperature TN has a relatively small influence on the downstream temperature TO, m during suspension of ink circulation is set to a relatively small value and n during the same is set to a relatively large value as compared with m and n during ink circulation.

It is to be noted that this embodiment is not necessarily exclusive to the second embodiment, and the second embodiment can be combined with this embodiment to be selectively used in accordance with a timing of a maintenance command. For example, in a printer to which both the second embodiment and this embodiment can be applied, a time A is set to 15 seconds, a time B is set to 10 seconds, and a time C is set to seconds.

In this setting, when the maintenance command is input at a time point that 18 seconds have passed after end of circulation, the purge operation can be performed from a time point of 28 seconds since the circulation operation is performed for 10 seconds in the second embodiment. However, according to this embodiment, when the time C is selected at a time point of 20 seconds or a later time point and start of the purge operation is delayed for 2 seconds, the purge operation can be carried out without performing the circulation operation. Thereby rapidly completing the maintenance operation as compared with the second embodiment.

As explained above, according to this embodiment, since the circulation operation is omitted and the nozzle temperature TN is determined based on the upstream temperature TI and the downstream temperature TO. Therefore, a waste liquid amount in the maintenance processing can be accurately calculated, and the maintenance operation can be rapidly performed.

A fourth embodiment will now be described.

In the first embodiment and the second embodiment, the nozzle temperature TN is estimated from the upstream TI and the downstream temperature TO at a given moment alone. This method is effective when a heat generation source and a heat absorption source are not present between the upstream temperature gauge 61 and the downstream temperature gauge 64. However, when heat is generated from a portion between the upstream temperature gauge 61 and the downstream temperature gauge 64 like special maintenance where heat is generated from, e.g., vibrating plates 4O, or when a fan or the like which operates at a predetermined temperature or a higher temperature is installed at any position in the printer 1, a determination includes unstable elements.

Its reason is as follows. In general, when a fluid flowing through a pipe line is heated or cooled from the outside of the pipe, since a temperature difference occurs between a part near a pipe wall and a central part of the pipe, a viscosity difference or a density difference occurs in the fluid. However, in this case, even if a pipe cross section have a uniform average temperature, a flow rate distribution or a secondary flow state differs depending on heating and cooling. As a result, a difference also occurs in thermal transfer characteristics. As a result, even if a nozzle temperature TN remains the same, a correlation to a downstream temperature TO differs depending on heating and cooling. Therefore, the nozzle temperature TN cannot be estimated from the upstream temperature TI and the downstream temperature TO at a given moment alone.

In this embodiment, the upstream temperature TI, the downstream temperature TO, and a temperature history of the downstream temperature TO are recorded in the control unit 9, and whether a humidification process or a cooling process is performed is determined based on this recording, and m and n in Expression (2) are determined.

For example, the downstream temperature TO at a predetermined time is recorded with a predetermined sampling frequency. If a differential coefficient at the nearest time in a polynomial approximate curve is larger than a predetermined positive number, it is determined that the humidification process is performed. If the same is smaller than a predetermined negative number, it is determined that the cooling processing is effected. If the same is larger than the predetermined negative number and smaller than the predetermined positive number, it is determined that a steady process is carried out. Such results are reflected in determination of m and n in Expression 2. Further, the differential coefficient may be reflected in determinate on of m and n in Expression 2. For example, in case of an ink whose viscosity is lowered as a temperature is increased, since heat is apt to be transferred in the heating process as compared with the cooling process, the downstream temperature TO may be relatively weighted in special maintenance, and weighting correction which is in proportion to the differential coefficient of the downstream temperature TO may be performed.

According to this embodiment, since a temperature history of the downstream temperature TO is also taken into consideration, the nozzle temperature TO can be accurately estimated even in a non-steady state such as a heating process or cooling process. It is to be noted that a temperature history of the upstream temperature TI rather than the downstream temperature TO may be recorded in a memory in the control unit 9, and this temperature history may be used as a material for a determination on a humidification process or a cooling process.

It is to be noted that, in place of recording temperature histories of the upstream temperature TI and the downstream temperature TO, a driving history of the recording head 4 may be recorded in the control unit 9, and a determination on a humidification process or a cooling process may be made by using this driving history.

The present invention includes the following overviews.

(1) There is provided an image recording apparatus comprising:

a recording head having a plurality of nozzles that eject an ink;

a common ink chamber which communicates with the plurality of nozzles;

an upstream ink path through which the ink is supplied to the common ink chamber;

a downstream ink path through which the ink is supplied from the common ink chamber;

an ink tank from which the upstream ink path is replenished with the ink by the image recording apparatus;

ink flowing means for sequentially causing the ink to flow to the upstream ink path, the common ink chamber, and the downstream ink path;

an upstream temperature gauge installed in the upstream ink path;

a downstream temperature gauge installed in the downstream ink path;

maintaining means for performing restoration processing that restores ejection properties of the recording head; and a control unit which enables the ink flowing means to cause the ink to flow and then detects a temperature of the nozzles in the recording head when an image forming operation by the recording head is finished or a predetermined time has passed from stopping of ink flow by the ink flowing means when detecting temperatures by the upstream temperature gauge and the downstream temperature gauge, wherein the control unit calculates a ejection amount of the ink ejected in the maintenance processing based on an ink temperature of the nozzles.

(2) There is provided the image recording apparatus according to the term (1), wherein the control unit estimates a temperature of the ink which passes through the nozzles based on an output from the upstream temperature gauge and each temperature output obtained by the temperature detection performed by the downstream temperature gauge, calculates an ink amount discarded in the maintenance processing by the maintaining means, and combines the calculated ink amount with an ink amount ejected in image formation by the recording head to calculate a remaining ink amount in the ink tank, and the notification unit issues a notification which urges replacement of the ink tank when the remaining ink amount is reduced to be lower than a preset determination value.

(3) There is provided an image forming apparatus, wherein the control unit uses a temperature output from the upstream temperature gauge as an upstream temperature TI and a temperature output from the downstream temperature gauge as a downstream temperature TO to determine a temperature of the ink passing through the nozzles based on the following expression:

$$TN=f(TI,TO)$$

where a function f(TI, TO) is a function which performs either internal division or external division with respect to the upstream temperature TI and the downstream temperature TO, and $f(TI, TO)=(n\times TI+m\times TO)/(m+n)$ (where m and n are actual numbers) is achieved.

(4) There is provided an ink waste amount calculation method for an image recording apparatus as a method of calculating an ink waste amount of an ink ejected from a recording head in maintenance processing in an image recording apparatus, the apparatus comprising: a recording head having a plurality of nozzles that eject the ink; a common ink chamber which communicates with the plurality of nozzles; an upstream ink path through which the ink is supplied to the common ink chamber; a downstream ink path through which the ink is supplied from the common ink chamber; ink flowing means for sequentially causing the ink to flow to the upstream ink path, the common ink chamber, and the downstream ink path; an upstream temperature gauge installed in the upstream ink path; a downstream temperature gauge installed in the downstream ink path; and maintaining means for performing maintenance processing that restores ejection properties of the recording head, wherein the method has: a step of calculating a temperature of the recording head based on an output from the upstream temperature gauge and an output from the downstream temperature gauge; and a step of calculating an ink waste amount based on the calculated temperature of the recording head and execution contents of the maintenance processing.

(5) There is provided a maintenance method for a recording head according to the terra (4), wherein the image recording apparatus comprises an ink tank from which the upstream ink path is replenished with the ink, and the maintaining means estimates an ink amount discarded in the restoration processing based on an output from the upstream temperature gauge and an output from the downstream temperature gauge.

(6) There is provided the maintenance method for a recording head according to the term (4), wherein a remaining ink amount in the ink tank is estimated based on a combination of the estimated ink amount discarded in the restoration processing and an ink amount used by the recording head.

(7) There is provided the maintenance method for a recording head according to the term (6) as the maintenance method used in the image recording apparatus, wherein replacement of the ink tank is instructed when the estimated remaining ink amount in the ink tank is reduced to be lower than a specified value.

According to the present invention, there can be provided the image recording apparatus which can estimate an ink temperature in the nozzle unit in the recording head and calculate a waste liquid amount of the ink ejected or discharged for a use application other than image recording, and the ink amount calculation method for this image recording apparatus.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image recording apparatus which records an image with respect to a recording medium, comprising:

a recording head which has a plurality of nozzles that eject an ink and a common ink chamber that communicates with the plurality of nozzles;

an upstream-side ink path which is connected with the recording head and through which the ink is supplied to the common ink chamber;

a downstream-side ink path which is connected with the recording head and through which the ink is discharged from the common ink chamber;

an ink path which annularly connects the upstream-side ink path, the common ink chamber, and the downstream-side ink path and through which the ink is circulated;

an upstream-side temperature gauge which is installed in the upstream-side ink path;

a downstream-side temperature gauge which is installed in the downstream-side ink path; and a maintenance unit which executes maintenance processing involving ejection of the ink from the nozzles to restore ink ejection performance in the recording head, wherein a control unit estimates a temperature of the recording head based on an output from the upstream-side temperature gauge and an output from the downstream-side temperature gauge and calculates an ink waste amount ejected from the nozzles by the maintenance processing based on the estimated temperature of the recording head and execution contents of the maintenance processing.

2. The apparatus according to claim 1, wherein the control unit estimates a temperature of the recording head based on respective outputs from the upstream-side temperature gauge and the downstream-side temperature gauge while the ink is circulated in the ink path or within a predetermined time after stopping of circulation.

3. The apparatus according to claim 2, wherein the control unit estimates a temperature of the recording head after confirming a circulation state of the ink.

4. The apparatus according to claim 3, wherein the control unit circulates the ink and then estimates a temperature of the recording head if a predetermined time has passed alter stopping of circulation of the ink.

5. The apparatus according to claim 3, wherein the control unit estimates a temperature of the recording head when the ink is being circulated or a predetermined time is yet to pass after stopping of circulation.

6. The apparatus according to claim 3, wherein the control unit circulates the ink, then obtains outputs from the upstream-side temperature gauge and the downstream-side temperature gauge, and estimates a temperature of the recording head based on an average value of the output from the upstream-side temperature gauge and the output from the downstream-side temperature gauge if a predetermined time has passed after stopping of circulation of the ink.

7. The apparatus according to claim 2, further having a pump which circulates the ink in the ink path, wherein the control unit confirms a driving state of the pump and then estimates a temperature of the recording head.

8. The apparatus according to claim 7, wherein the control unit confirms a driving state of the pump and then estimates a temperature of the recording head.

9. The apparatus according to claim 7, wherein the control unit drives the pump to circulate the ink and then estimates a temperature of the recording head if a predetermined time has passed after stopping of circulation of the ink.

10. The apparatus according to claim 7, wherein the control unit estimates a temperature of the recording head if the pump is being driven or a predetermined time is yet to pass after stopping of driving.

11. The apparatus according to claim 7, wherein the control unit drives the pump to circulate the ink, then obtains outputs from the upstream-side temperature gauge and the downstream-side temperature gauge, and estimates a temperature of the recording head based on an average value of the output from the upstream-side temperature gauge and the output from the downstream-side temperature gauge if a predetermined time has passed after stopping of driving of the pump.

12. The apparatus according to claim 2, wherein the control unit internally divides or externally divides the output from the upstream-side temperature gauge and the output from the downstream-side temperature gauge based on a predetermined internal division ratio or external division ratio to estimate a temperature of the recording head.

13. The apparatus according to claim 12, further comprising the temperature recording unit which records a history of at least one of the output from the upstream-side temperature gauge and the output from the downstream-side temperature gauge, wherein the control unit determines whether the ink is in a heating process or a cooling process from the history recorded in the temperature recording unit and determines the internal division ratio or the external division ratio in accordance with a result of the determination.

14. The apparatus according to claim 12, further comprising a head driving state recording unit which records a history of a driving state of the recording head, wherein the control unit determines whether the ink is in a heating process or a cooling process from a history recorded in the head driving state recording unit and determines the internal division ratio or the external division ratio in accordance with a result of the determination.

15. The apparatus according to claim 12, wherein the control unit calculates a difference between the output from the upstream-side temperature gauge and the output from the downstream-side temperature gauge and performs internal division based on a result of the calculation.

16. The apparatus according to claim 1, further comprising an ink tank from which the upstream-side ink path is replenished with the ink, wherein the control unit combines the calculated ink waste amount with an ink amount used for image recording before maintenance processing to estimate a remaining ink amount in the ink tank.

17. An image recording apparatus comprising:

a recording head which has a plurality of nozzles that eject an ink and a common ink chamber that communicates with the plurality of nozzles;

an ink path which has an upstream-side ink path through which the ink is supplied so the common ink chamber, a downstream-side ink path through which the ink is supplied from the common ink chamber, and an ink tank from which the upstream-side ink path is replenished with the ink, and annularly connects the respective paths with the tank to circulate the ink;

a pump which circulates the ink in the ink paths;

an upstream-side temperature gauge which is installed in the upstream-side ink path;

a downstream-side temperature gauge which is installed in the downstream-side ink path; and a maintenance unit which performs maintenance processing that restores ejection properties of the recording head, wherein the control unit circulates the ink by the pump, then uses the upstream-side temperature gauge and the downstream-side temperature gauge to detect respective temperatures, calculates an ink temperature of the nozzles from the respective temperatures, and calculates a waste liquid amount of the ink ejected from the nozzles in the maintenance processing based on the ink temperature when the recording head is in a non-image-forming operation state.

18. The apparatus according to claim 17, further having a notification unit that performs notification with respect to a user of the image recording apparatus, wherein the control unit combines the calculated ink waste amount with an ink ejection amount ejected in image formation performed by the recording head to calculate a remaining ink amount in the ink tank, and uses the notification unit to notify of replacement of the ink tank when the remaining ink amount in the ink tank is reduced to be lower than a preset threshold value.

19. The apparatus according to claim 17, wherein, assuming that TI is an upstream-side temperature as a temperature output from the upstream-side temperature gauge and TO is a downstream-side temperature as a temperature output from the downstream-side temperature gauge, the control unit determines a temperature of the ink which passes through the nozzles based on the following expression:

$$TN=f(TI,TO)$$

where a function f(TI, TO) is a function that performs either internal division or external division with respect to the upstream-side temperature TI and the downstream-side temperature TO, and $f(TI, TO)=(n\times TI+m\times TO)/(m+n)$ (where m and n are actual numbers) is achieved.

20. An ink waste amount calculation method in an image recording apparatus, the apparatus comprising:

a common ink chamber which communicates with a plurality of nozzles;

an upstream-side ink path through which an ink is supplied to the common ink chamber;

a downstream-side ink path through which the ink is ejected from the common ink chamber;

an ink flow unit which circulates the ink in the upstream-side ink path, the common ink chamber, and the downstream-side ink path in the mentioned order;

an ink tank from which the upstream-side ink path is supplied with the ink;

an upstream-side temperature gauge which is installed in the upstream-side ink path and measures a temperature of the flowing ink;

a downstream-side temperature gauge which his installed in the downstream-side ink path and measures a temperature of the flowing ink; and a maintenance unit which performs maintenance processing that restores ejection properties of the recording head, the method comprising:

a process of obtaining an output from the upstream-side temperature gauge and an output from the downstream-side temperature gauge;

a process of calculating a temperature of the recording head based on the output from the upstream-side temperature gauge and the output from the downstream-side temperature gauge; and a process of calculating an ink waste amount ejected from the nozzles based on the calculated temperature of the recording head and execution contents of the maintenance processing.

21. The method according to claim 20, further having a remaining ink amount calculation process of calculating a remaining ink amount in the upstream-side and downstream-side ink paths based on a combination of the calculated ink waste amount and an ink ejection amount used in image recording.

22. The method according to claim 21, further having a notification process of notifying of replacement of the ink tank when the calculated remaining ink amount in the upstream-side and downstream-side ink path becomes equal to or below a specified value.

* * * * *